US010076200B2

(12) United States Patent
Jones et al.

(10) Patent No.: US 10,076,200 B2
(45) Date of Patent: Sep. 18, 2018

(54) BARBECUE TRIVET

(71) Applicant: Base4 Group, Inc., Carollton, TX (US)

(72) Inventors: Autumn Alexis Jones, Dallas, TX (US); Joseph Charles Thompson, Lewisville, TX (US)

(73) Assignee: BASE4 VENTURES, LLC, Carrollton, TX (US)

( * ) Notice: Subject to any disclaimer, the term of this patent is extended or adjusted under 35 U.S.C. 154(b) by 29 days.

(21) Appl. No.: 15/330,089

(22) Filed: Aug. 4, 2016

(65) Prior Publication Data

US 2017/0311743 A1 Nov. 2, 2017

Related U.S. Application Data

(63) Continuation-in-part of application No. 29/505,957, filed on Apr. 28, 2016, now Pat. No. Des. 790,926.

(51) Int. Cl.
*A47G 21/14* (2006.01)
*B65D 1/36* (2006.01)

(52) U.S. Cl.
CPC ..... *A47G 21/14* (2013.01); *B65D 1/36* (2013.01)

(58) Field of Classification Search
CPC ..... A47G 21/14; A47G 23/06; A47G 19/02; B65D 1/36
USPC ..... 206/553; 220/574, 575
See application file for complete search history.

(56) References Cited

U.S. PATENT DOCUMENTS

| | | | | | |
|---|---|---|---|---|---|
| 2,652,702 | A * | 9/1953 | Hintze | A47G 19/06 | 206/541 |
| D211,320 | S * | 6/1968 | Hanseter et al. | D7/553.3 | |
| 3,532,247 | A * | 10/1970 | Bridges | B65D 81/3834 | 206/217 |
| D284,341 | S * | 6/1986 | Zajac | D7/504 | |
| 5,558,253 | A * | 9/1996 | Malvasio | A47G 19/02 | 220/556 |
| 5,638,981 | A * | 6/1997 | Crane | A47G 19/02 | 220/574.1 |
| 5,925,390 | A * | 7/1999 | Kornacki | A01K 5/0114 | 119/51.5 |
| D440,118 | S * | 4/2001 | Claffy | D7/553.1 | |
| 6,409,021 | B1 * | 6/2002 | Ramirez | B65D 1/36 | 206/564 |
| D539,606 | S * | 4/2007 | Whittington | D7/504 | |
| D651,047 | S * | 12/2011 | Johnson | D7/553.1 | |
| D659,479 | S * | 5/2012 | Peck | D7/555 | |
| 2011/0132914 | A1 * | 6/2011 | Vernes | A47G 19/06 | 220/575 |

* cited by examiner

*Primary Examiner* — Steven A. Reynolds
(74) *Attorney, Agent, or Firm* — Jonathan E. Grant; Grant Patent Services

(57) ABSTRACT

A barbecue tool trivet discloses a unitary structure, said unitary structure having a bottom section, a side section, and a top section. The top section contains three pocket recesses. Each of the recesses contains three pocket recesses, one next to the other, with the middle pocket recess being larger than either of the side pockets. There is at least one cut out in a rim that goes around the circumference of the trivet, and two tall side walls in one of the pocket recesses. In one embodiment, the middle recess is at least twice as large as either of the side pocket recesses.

7 Claims, 8 Drawing Sheets

BARBECUE TRIVET

This application is continuation-in-part of U.S. patent application Ser. No. 29/505,957,filed Apr. 28, 2016.

Each year, Americans spend billions of dollars on charcoal and gas barbecues, barbecue sauces, barbecue brushes, tongs, forks, plates, plastic utensils, picnic baskets, etc. To some novices and even seasoned barbecues, barbecuing has too many implements and not enough places to put them This present disclosure teaches a barbecue tool trivet which provide not merely a place to hold the barbecue tools, but a device that can be easily drained of extra sauce and liquids.

The present disclosure will become more apparent upon reading of the following non-restrictive description thereof, given for the purpose of exemplification only, with reference to the accompanying drawings.

DETAILED DESCRIPTION OF THE DISCLOSURE

Figure 1:
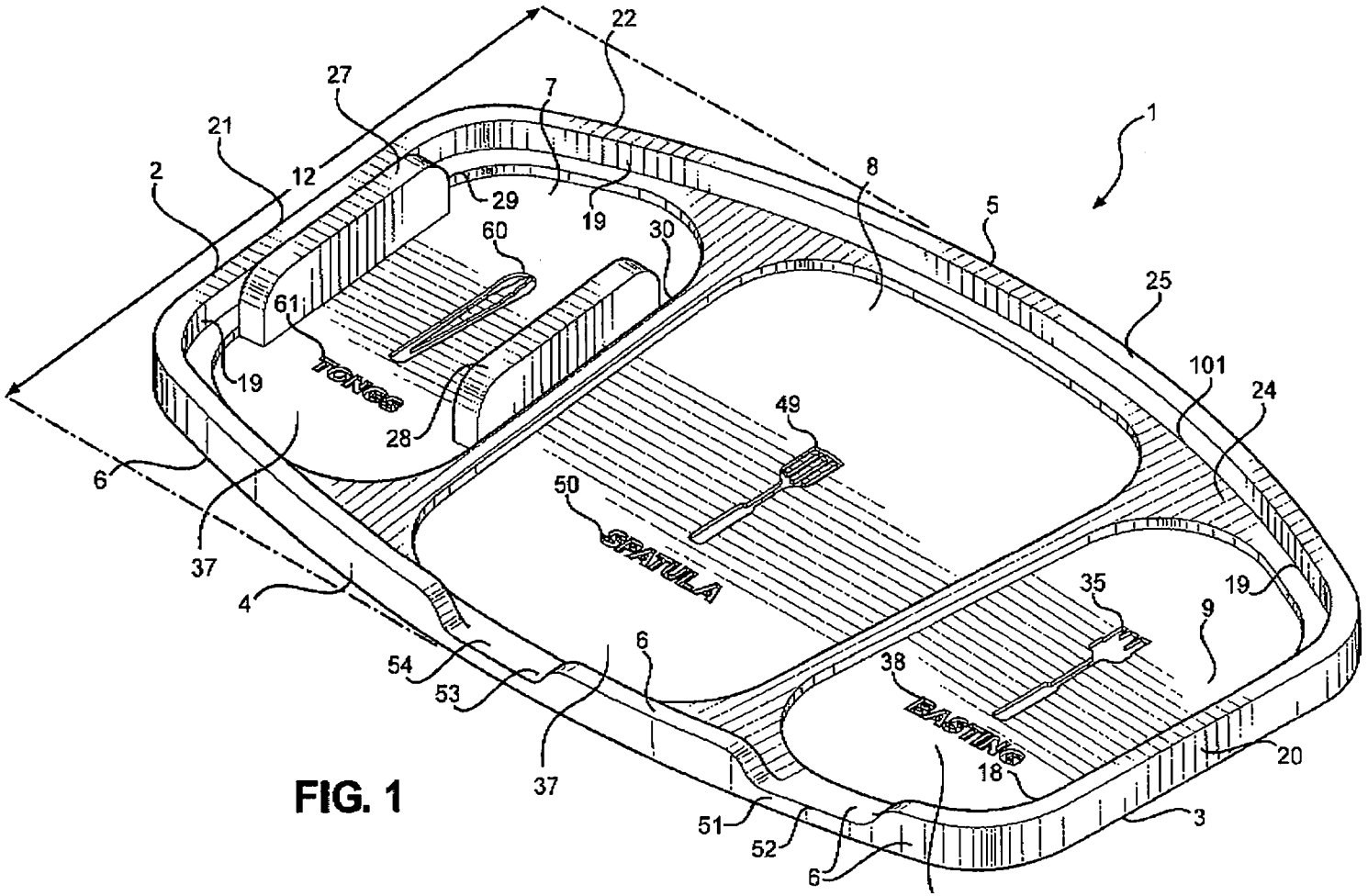
FIG. 1 is a perspective view of the barbecue tool trivet.
Figure 2:
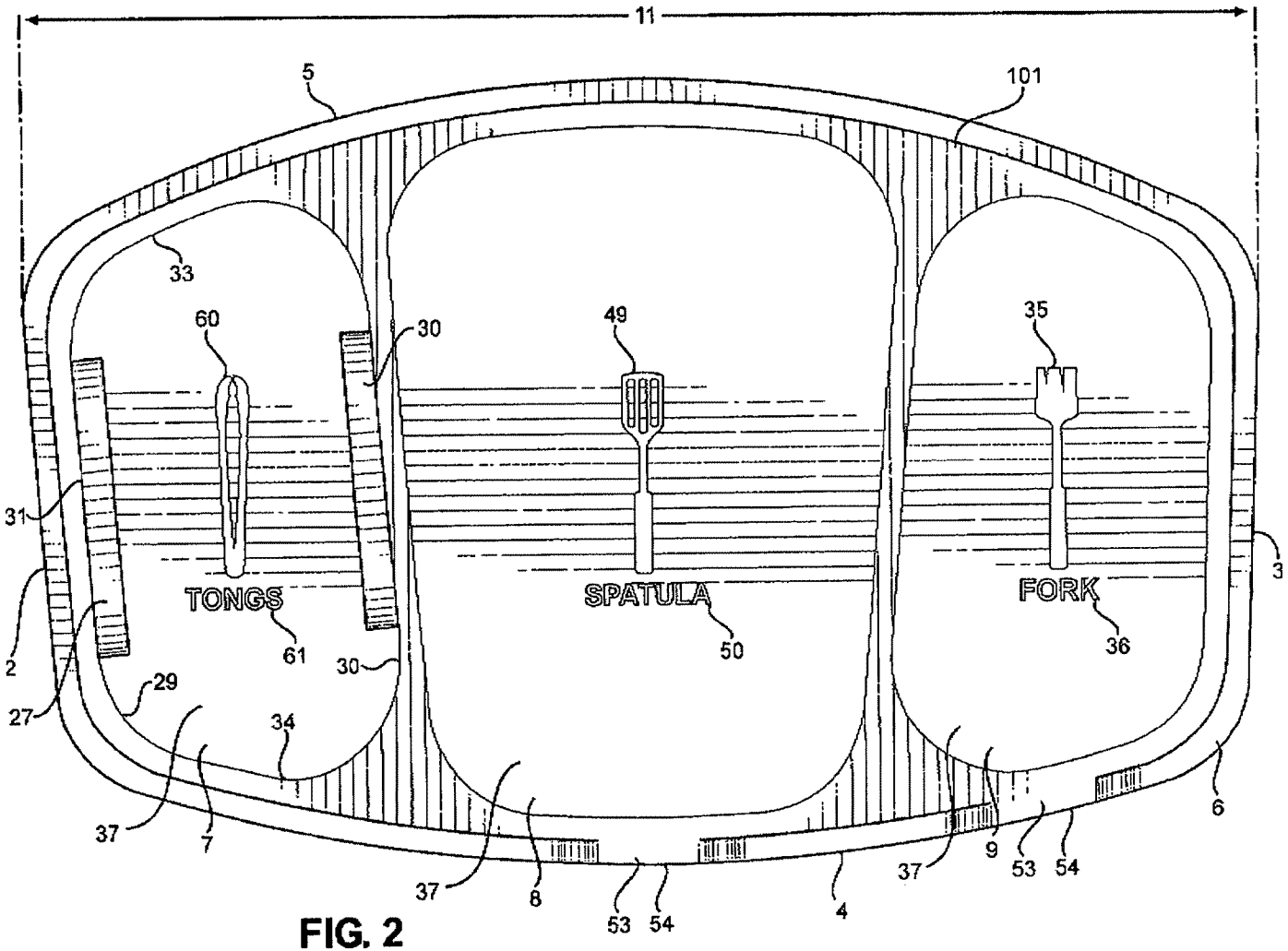
FIG. 2 is an overhead of the barbecue tool trivet.
Figure 3:
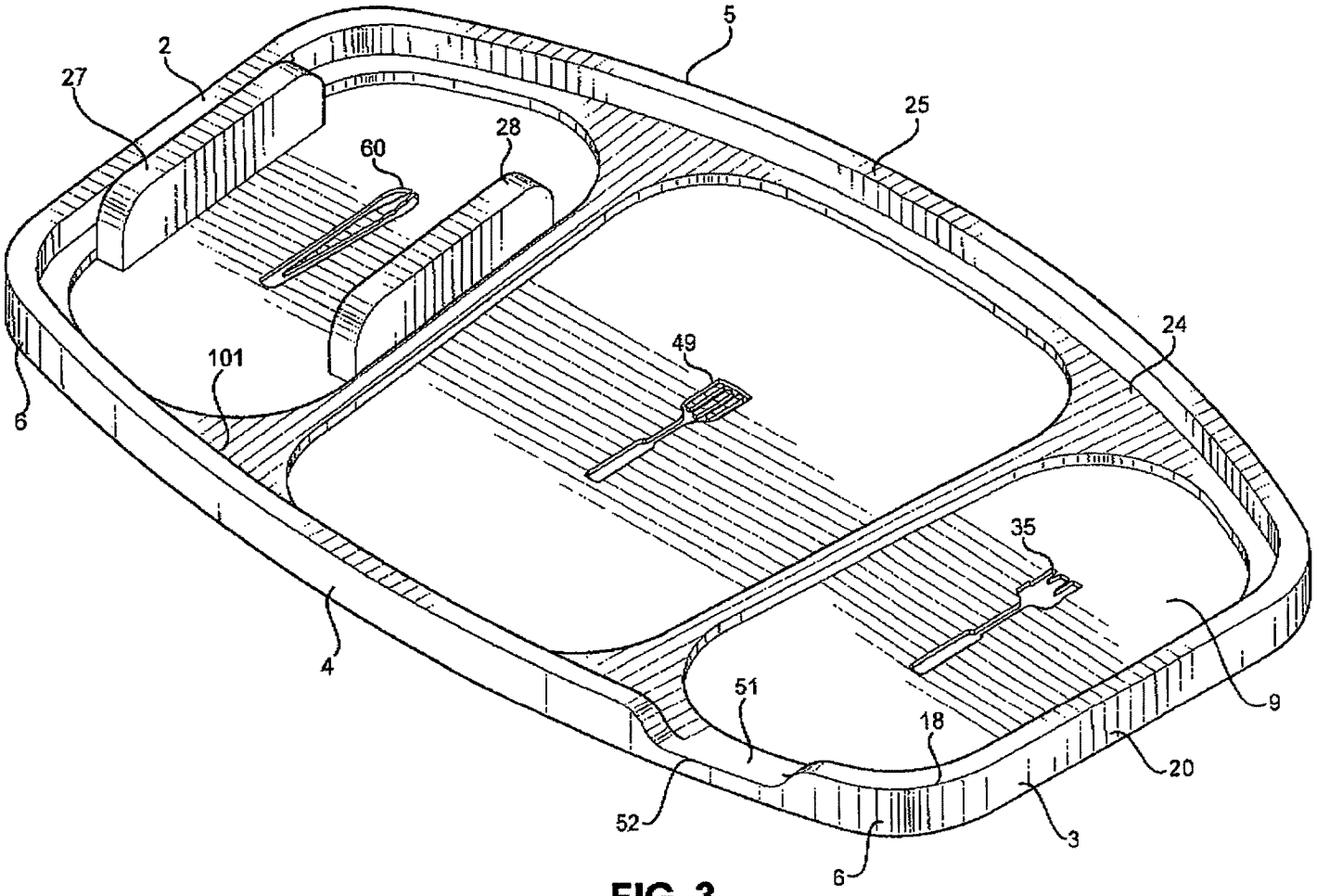
FIG. 3 is a perspective view of another embodiment of the barbecue tool trivet.
Figure 4:
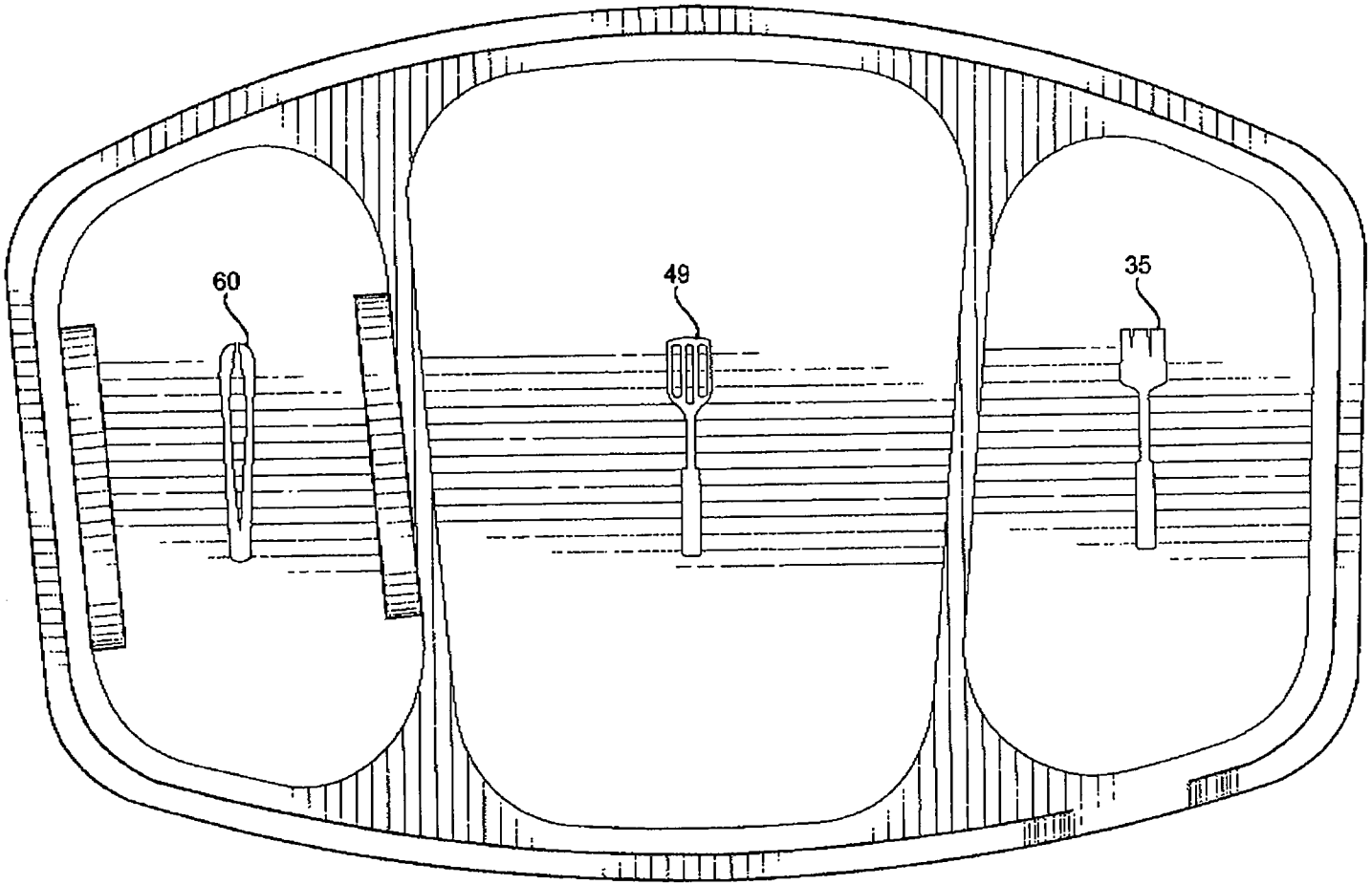
FIG. 4 is an overhead view of the barbecue tool trivet of FIG. 3.
Figure 5:
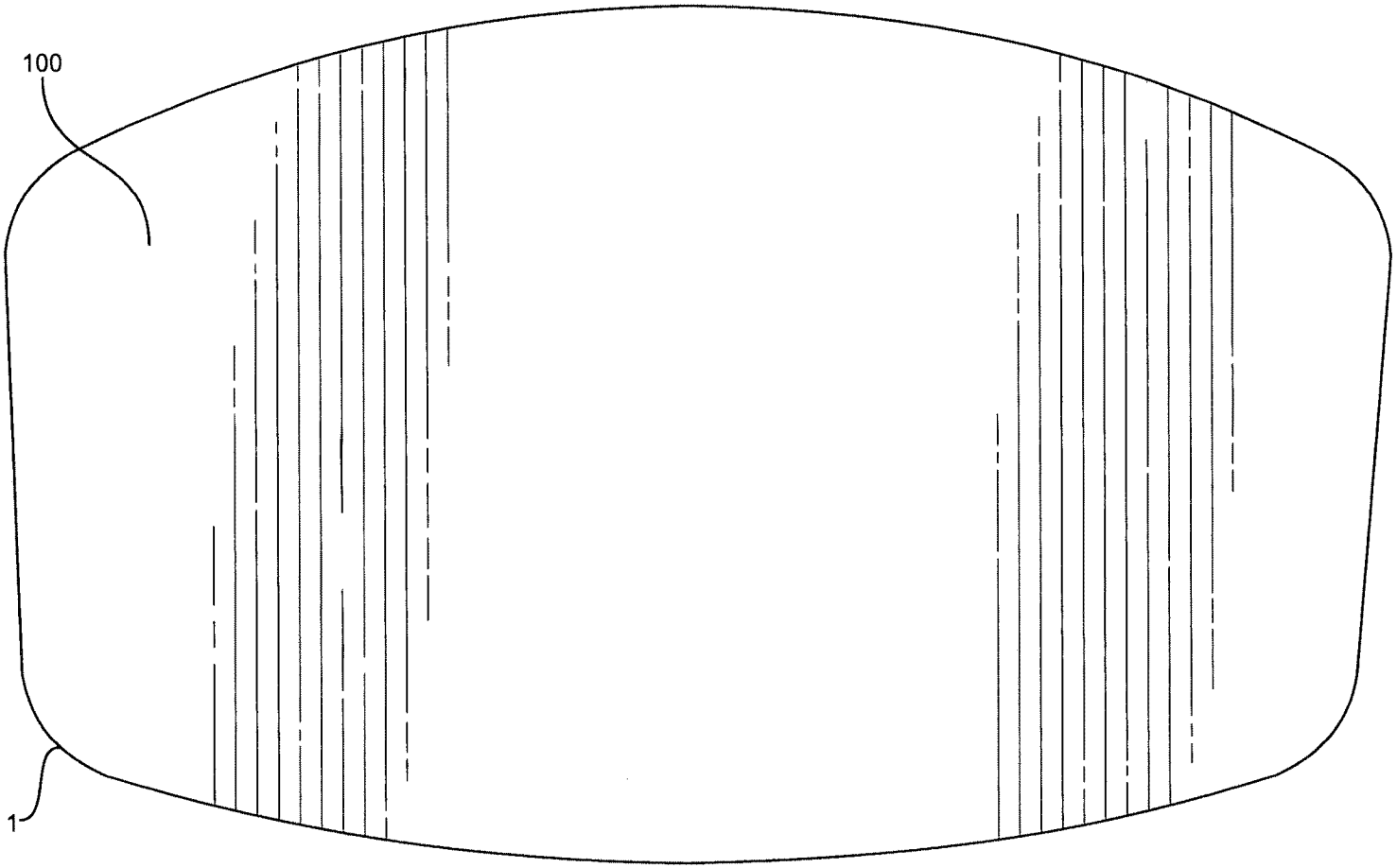
FIG. 5 is a back view of the barbecue tool trivet.
Figure 6:
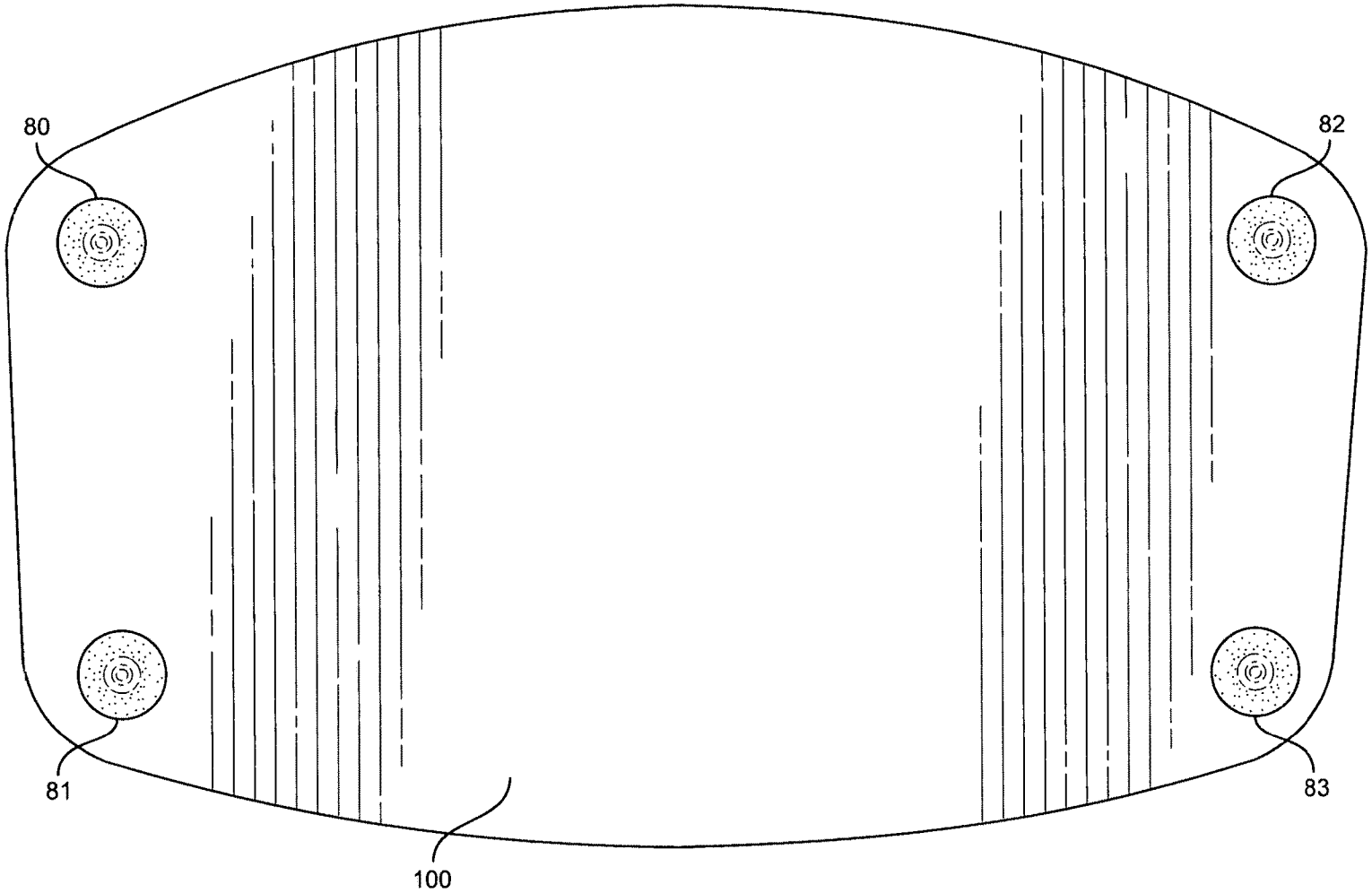
FIG. 6 is a back view of the barbecue tool trivet with feet.
Figure 7:
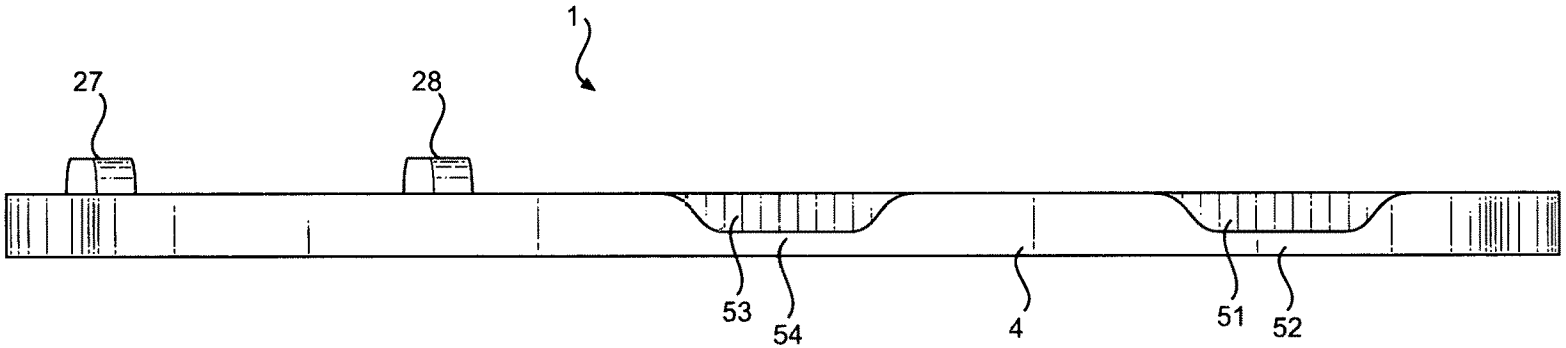
FIG. 7 is a front side view of the barbecue tool trivet.
Figure 8:
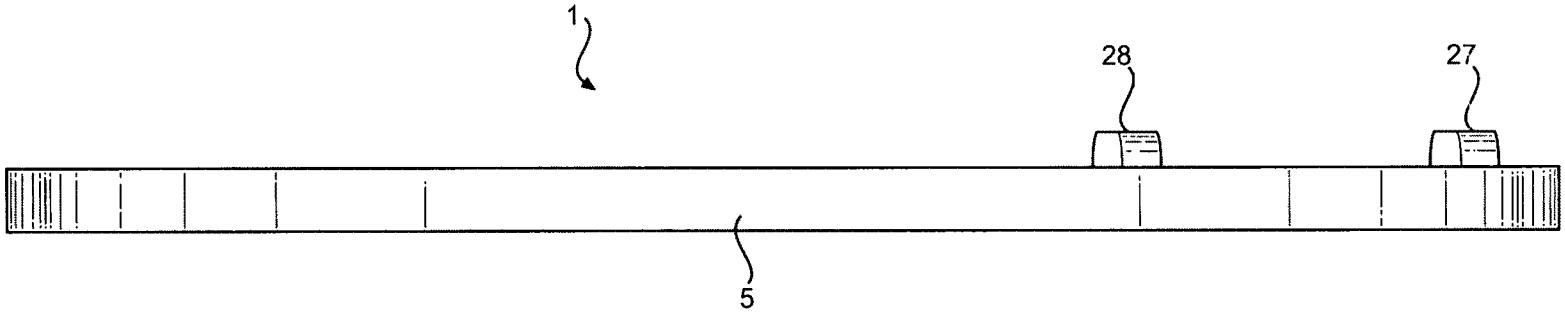
FIG. 8 is a back side view of the barbecue tool trivet.
Figure 9:
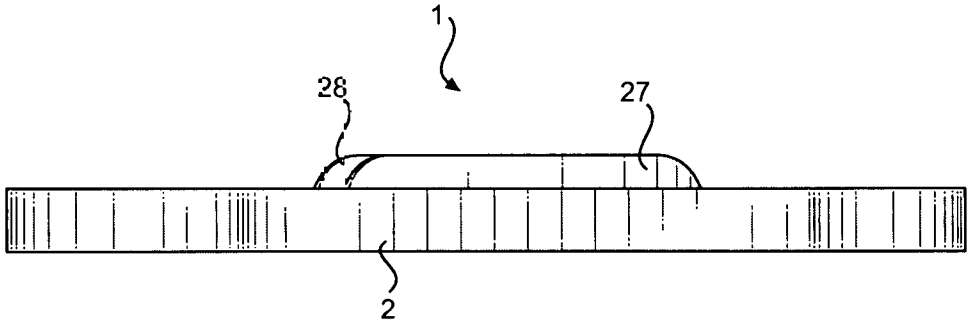
FIG. 9 is a first side view of the barbecue tool trivet.
Figure 10:
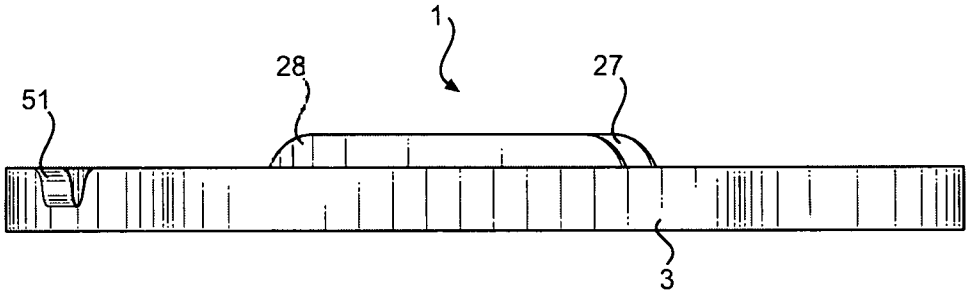
FIG. 10 is a second side view of the barbecue tool trivet.

Referring to FIGS. 1-8, the barbecue tool trivet 1 may be made out of silicone, wood, plastic, aluminum or steel or combinations thereof. It can be square, rectangular, or can have other elongated shapes. In one embodiment, the barbecue trivet is unitary; in other words, the barbecue tool trivet is integral and made out of one unitary piece of material. The barbecue trivet can be made from a mold or by stamping the material. If the barbecue trivet 1 is made out of wood, it can be made from strips of wood, or from one solid piece of wood that is tooled.

The barbecue tool trivet 1 has a bottom section 100, a top section 101, and sides 2,3,4, and 5. In the present figures, short sides 2 and 3 are straight, and sides 4 and 5 are elongated and curved. This can be varied such that the sides 4 and 5 can be parallel, and sides 2 and 3 are curved. All sides can be straight or curved.

The bottom section 100 of the barbecue tool trivet 1 is flat. In another embodiment, the bottom section 100 can have feet 80, 81, 82, 83 positioned in each corner of the bottom section 100, either integral with the bottom section or added to the bottom section and connected by any known means.

A rim 6 extends around sides 2, 3, 4, 5, and is integral with the barbecue tool trivet 1. Measuring from the outside 18 of the rim 6 of short side 2 and short side 3, the barbecue tool trivet 1 ranges in length 11from about 10 inches to about 15 inches, and in another embodiment, the length 11 ranges from about 11 inches to about 13 inches, and in another embodiment, the length 11 ranges from about 12 inches to about 13 inches. In another embodiment, the length is 12.22 inches. The width 12 of the barbecue tool trivet ranges from about 6 inches to about 12 inches, and in another embodiment, the width 12 measures from about 7 inches to about 10" and in another embodiment the width 12 ranges from about 7 inches to about 9 inches. In one embodiment, the width is about 7.84 inches and the length is 12.22 inches. In one embodiment, the width 10 of the rim 6 is between about ⅜ inch and about ¾ inch. In one embodiment, the width of the rim 6 is 0.24 inches.

The height 13 of the rim 6 of the barbecue tool trivet 1 ranges from about 0.4 inches to 1 inch. In another embodiment, the height 13 is about 0.5 inches to 0.75 inches and in another embodiment (shown), the thickness 13 is about 0.51 inches.

The front section 101 of the trivet has three separate pocket recesses 7, 8, 9. The pocket recesses 7, 8, 9, can be rectangular, rectangular with rounded corners, or oblong. In another embodiment, the recesses form a rounded corners trapezoid In one embodiment, the middle pocket recess 8 is larger than the two side pocket recesses 7, 9. In another embodiment, middle pocket recess 8 is at least twice as large as either side pocket 7 or 9. In another embodiment, the general outline shape of pocket recesses 7, 9 are mirror images of each other.

There is a minimum distance between the straight sections 20, 21, 22 of the outside of rim 6 of the pocket depression 7,8,9, and the inside 19 of the rim 6. ranges from about a 0.15 inches to about 0.30 inches. In another embodiment. In another embodiment, the straight sections are from about 0.2 to about 0.3 inches from the inside wall 19 of the rim 6, and in another embodiment, the distance is about 0.24 inches. These figures may vary by a couple of fractions of inches, depending on the manufacturing processes.

The surface 24 of the barbecue grill trivet 1 is from about 0.25 to 0.35 inches below the top surface 25 of the rim 6. In another embodiment, the surface of the barbecue tool trivet 1 is from about 0.28-0.33 inches below the surface 25 of the rim 6, and in another embodiment, the The pocket recesses 7,8,9, can be from about 0.25 inches to about 0.4 inches in depth. In another embodiment, the pocket recesses 7, 8, 9 are from about 0.25 to about 0.35 inches in depth. In another embodiment, shown in the figures, the pocket recesses measure 0.31 inches in depth from the surface 14 of the barbecue tool trivet 1.

The pocket recesses 7,8,9 have a depth of between about 0.09 to about 0.15 inches from the surface 24. In another embodiment, pocket recesses 7,8,9 are about 0.12" In this version of the barbecue tool trivet, where the surface 24 is 0.31 inches below the top surface 25 of the rim 6, and the pocket recesses 7,8, 9, are about 0.12 inches in depth, the bottom 26 of the barbecue grill trivet 1 is about 0.08 inches in width. It should be noted that these figures may differ depending on the relative size of the trivet, although the length of the trivet should not greatly affect the ratios of the numbers given. Furthermore, the bottom of the grill trivet can be thicker or thinner, depending on the materials used.

As noted there are three pocket recesses, 7,8,9. The outer pocket recesses 7 and 9 are designed to hold tongs and/or a basting brush, respectively, while the inner or middle pocket recess 8 holds a spatula.

The pocket recess 7 for the tongs, and in the illustrations FIG. 1, includes two walls 27, 28. These tong walls 27, 28 are positioned opposite and parallel to each other inside and along the long sides 29, 30 of pocket recess 7. These tong walls 27, 28 serve the purpose of helping to retain the tongs in place, when the tongs are in an expanded position. The tong walls 27, 28 can be of almost any width. For example, in one embodiment, tong walls 27, 28 are from about 0.1 inches to 0.5 inches wide. In another embodiment, tong walls 27, 28 are about from 0.2 inches to 0.4 inches wide and in another embodiment, tong walls 27, 28 are from about 0.25 inches to about 0.4 inches wide. In one embodiment, as an example the tong walls 27, 28 are 0.31 inches wide. Tong walls 27, 28 are from about 0.5 inches to about 1 inch tall, measured from the bottom of pocket recess 7. In another embodiment, tong walls 27, 28 are about 0.5 to about 0.75 inches tall from the bottom of pocket recess 7, and in one embodiment, the tong walls are 0.71 inches tall from the bottom of pocket recess 7. The tong walls need to be long enough to prevent the tongs from spreading. In one embodiment the tong walls 27, 28 are about 2 to about 5 inches long, and in another embodiment, they are about 2 to about 3 inches long, and in another embodiment, they are 2.91 inches long.

On the floor of the pocket recess 7, there is imprinted either an image of a pair of tongs 60 and/or the word "tongs" 61.

The pocket recess 7 itself roughly has roughly the shape of a trapezoid. In another embodiment, the "trapezoid" has rounded corners, giving the effect of a trapezoidal outline with rounded corners. In one embodiment, the smaller of the two walls ranges from about 4 inches to about 6 inches, and then from about 4 inches to about 5 inches and in another embodiment, wall 29, 30 is 4.51 inches in length, and walls, has a width of about 6 inches to about 7 inches, while in another embodiment the width is about 6.4" inches. The angular measure of the walls 33, 34 is from about 3 to about 4 inches, while in one embodiment, the measurement is 3.26". The figures show how measurements are determined.

It should be noted that pocket recess 9 is a mirror image of pocket recess 7, except for two principle differences. Pocket recess 9 does not have tong walls 27, 28 and there is no image or word mentioning tongs. However, pocket recess 9 has an image of a basting brush 38 and/or the words "basting brush"39 imprinted or engraved into the floor 37 of pocket recess 9. In an alternative embodiment, the word "fork" 35 is engraved into the floor 37 of pocket recess 9. In another embodiment, the image of a fork 36 is engraved into the floor In another embodiment, the words are both engraved or imprinted into the floor 37 of pocket recess 9.

Pocket recess 8 is positioned between pocket recess 7 and pocket recess 9. Pocket recess 8. Pocket recess 8 is more than 2× larger than pocket recess 7 or 9, and is larger than pocket recess 7 and pocket recess 8. In one embodiment, pocket recess 8 has the overall appearance of a a trapezoid with rounded corners 40, 41, 42, 43. Pocket recess 8 has one short wall 44, a top wall 45 which is longer than the short wall 44, and pocket recess side walls 46, 47 are of equal length. In another embodiment, the top wall 45 of pocket recess 8 has a curvature.

Measuring from a center point of pocket recess 8, the width of pocket recess 8 ranges from about 4 inches to about 6 inches, and in one embodiment, is 4.96 inches, and the length of the trivet is from about 6 inches to about about 8 inches, and in one embodiment is 6.89 inches. In a number of cases, pocket recess is large enough to be at least twice as large as pocket recess 7 or 9.

In the middle of the pocket recess 8 is either the word "spatula" 49 and/or an image 50 of a spatula.

There is at least one cut out 51 in the rim 6, in front of one the pocket recesses. The middle 52 of the cut out 51 is the same height as the surface 24. In one embodiment, there is a cut out 51 on the front side of the barbecue tool trivet 1 in front of pocket recess 9. The cut out is between about 1 to about 1.5 inches long.

In another embodiment, there is a second cut out 53 in front of pocket recess 8. As above, the middle 54 of the cut out 53 is the same height as the surface 24. The cutouts allow for the staff(s) of the spatula and basting brush will rest in the recesses more securely.

The dimensions given here can be varied.

It is to be understood that even though numerous characteristics and advantages of the present embodiments have been set forth in the foregoing description with details of the structures and functions of the embodiments, the disclosure is illustrative only, and changes made in detail, especially in matters of shape, size, and arrangement of parts, within the principles of the embodiments, to the full extent indicated by the broad general meaning of the terms in which the appended claims are expressed

What is claimed is:

1. A barbecue tool trivet comprising a unitary structure, said unitary structure comprising:

a) a front side;

b) a rear side;

c) a left side connecting said front side and said rear side;

d) a right side connecting said front side and said rear side;

e) a rim circumferencing and extending upward from said front side, said rear side, said left side and said right side;

f) a flat surface surrounded and bounded by said rim;

g) a first pocket recess comprising a first pocket recess floor positioned below and circumvented by said flat surface;

h)a second pocket recess, said second pocket recess being a mirror image of said first pocket recess comprising a second pocket recess floor positioned below and circumvented by said flat surface;

i) a third pocket recess, said third pocket recess positioned between said first pocket recess and said second pocket recess, said third pocket recess comprising a third pocket recess floor positioned below and circumvented by said flat surface;

j) at least one depression in said rim, said depression being positioned in front of said third pocket recess, said depression being of the same level and integral with the flat surface; and k) two tong walls, said two tong walls positioned in parallel with one another on either side of an interior perimeter of said first pocket recess, extending upward perpendicularly from said first pocket recess floor.

2. The barbecue tool trivet of claim 1, wherein said barbecue trivet is comprised of a material selected from the group consisting of silicone, wood, plastic, aluminum, steel and combinations thereof.

3. The barbecue tool trivet of claim 1, further comprising a second depression in said rim said second depression positioned in the rim in front of said second pocket recess.

4. The barbecue tool trivet of claim 1, further comprising:

a) a first engraving in the first pocket recess indicating a pair of tongs, said first engraving being selected from the group consisting of the letters spelling out the word tongs, an image of a pair of tongs, and a combination thereof;

b) a second engraving in the second pocket recess indicating a spatula, said second engraving being selected from the group consisting of the letters spelling out the words spatula, an image of a spatula, and a combination thereof ; and c) a third engraving in the third pocket recess indicating a basting brush, said third engraving being selected from the group consisting of the letters spelling out the words basting brush, an image of a basting brush, and a combination thereof.

5. The barbecue tool trivet of claim 1, further comprising:

a) a first engraving in the first pocket recess indicating a pair of tongs, said first engraving being selected from the group consisting of the letters spelling out the word tongs, an image of a pair of tongs, and combinations thereof;

b) a second engraving in the second pocket recess indicating a spatula, said second engraving being selected from the group consisting of the letters spelling out the words spatula, an image of a spatula, and combinations thereof ; and c) a third engraving in the third pocket recess indicating a fork, said third engraving being selected from the group consisting of the letters spelling out the word fork, an image of a fork, and combinations thereof.

6. The barbecue tool trivet of claim 1, wherein said left side and said right side arc parallel to each other.

7. The barbecue tool trivet of claim 6, wherein said front side and said rear side are curved.

* * * * *